US011169467B2

(12) United States Patent
Hashimoto et al.

(10) Patent No.: US 11,169,467 B2
(45) Date of Patent: Nov. 9, 2021

(54) DEVELOPER CARTRIDGE WITH A COVER COVERING A MEMORY ON AN OUTER SURFACE OF A TONER HOUSING

(71) Applicant: BROTHER KOGYO KABUSHIKI KAISHA, Nagoya (JP)

(72) Inventors: Junichi Hashimoto, Toyohashi (JP); Go Iwasa, Nagoya (JP); Masayoshi Mita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/774,640

(22) Filed: Jan. 28, 2020

(65) Prior Publication Data

US 2020/0310296 A1 Oct. 1, 2020

(30) Foreign Application Priority Data

Mar. 25, 2019 (JP) ..... JP2019-055914

(51) Int. Cl.
*G03G 15/08* (2006.01)
*G03G 21/18* (2006.01)
(Continued)

(52) U.S. Cl.
CPC ..... *G03G 15/0889* (2013.01); *G03G 15/0863* (2013.01); *G03G 15/0896* (2013.01); *G03G 15/80* (2013.01); *G03G 21/1652* (2013.01); *G03G 21/1832* (2013.01); *G03G 21/1867* (2013.01); *G03G 21/1875* (2013.01); *G03G 21/1878* (2013.01); *G03G 21/1885* (2013.01);
(Continued)

(58) Field of Classification Search
CPC ..... G03G 15/0863; G03G 15/0896; G03G 15/553; G03G 15/556; G03G 15/80; G03G 21/1652; G03G 21/1803; G03G 21/1814; G03G 21/1832; G03G 21/1867; G03G 21/1875; G03G 21/1878; G03G 21/1885; G03G 2215/0697; G03G 2221/1823; G03G 15/0889
See application file for complete search history.

(56) References Cited

U.S. PATENT DOCUMENTS

2017/0185032 A1* 6/2017 Itabashi ..... G03G 15/0863
2018/0088490 A1* 3/2018 Koyama ..... G03G 15/0875
2018/0107155 A1 4/2018 Shimizu et al.

FOREIGN PATENT DOCUMENTS

JP 2018-66973 A 4/2018

* cited by examiner

*Primary Examiner* — Joseph S Wong
(74) *Attorney, Agent, or Firm* — Merchant & Gould P.C.

(57) ABSTRACT

A developer cartridge includes a housing, a developing roller, an agitator, a memory, and a cover. The housing is configured to store toner therein and has one end portion and the other end portion in a first direction. The developing roller is rotatable about a first axis extending in the first direction. The agitator is rotatable about a second axis extending in the first direction. The agitator is positioned spaced apart from the developing roller. The memory includes an electrical contact surface. The electrical contact surface is positioned at an outer surface of the housing and at the one end portion of the housing in the first direction, and is disposed between the developing roller and the agitator in a second direction from the first axis toward the second axis. The cover has an opening open in the second direction and covers the electrical contact surface.

9 Claims, 7 Drawing Sheets

(51) Int. Cl.
*G03G 21/16* (2006.01)
*G03G 15/00* (2006.01)

(52) U.S. Cl.
CPC ..... *G03G 2215/0697* (2013.01); *G03G 2221/1823* (2013.01)

DEVELOPER CARTRIDGE WITH A COVER COVERING A MEMORY ON AN OUTER SURFACE OF A TONER HOUSING

CROSS-REFERENCE TO RELATED APPLICATION

This application claims priority from Japanese Patent Application No. 2019-055914 filed on Mar. 25, 2019, the content of which is incorporated herein by reference in its entirety.

TECHNICAL FIELD

Aspects of the disclosure relate to a developer cartridge including a memory.

BACKGROUND

A known developer cartridge includes a memory. The memory stores information regarding the developer cartridge.

SUMMARY

In the known developer cartridge, an electrical contact surface of the memory is not covered. This may cause unnecessary rubbing against the electrical contact surface of the memory.

Aspects of the disclosure provide a developer cartridge including a memory while preventing or reducing unnecessary rubbing against an electrical contact surface of the memory.

According to one or more aspects of the disclosure, a developer cartridge includes a housing, a developing roller, an agitator, a memory, and a cover. The housing is configured to store toner therein and has one end portion and the other end portion in a first direction. The developing roller is rotatable about a first axis extending in the first direction. The agitator is rotatable about a second axis extending in the first direction. The agitator is positioned spaced apart from the developing roller. The memory includes an electrical contact surface. The electrical contact surface is positioned at an outer surface of the housing and at the one end portion of the housing in the first direction, and is positioned between the developing roller and the agitator in a second direction from the first axis toward the second axis. The cover has an opening open in the second direction and covers the electrical contact surface.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
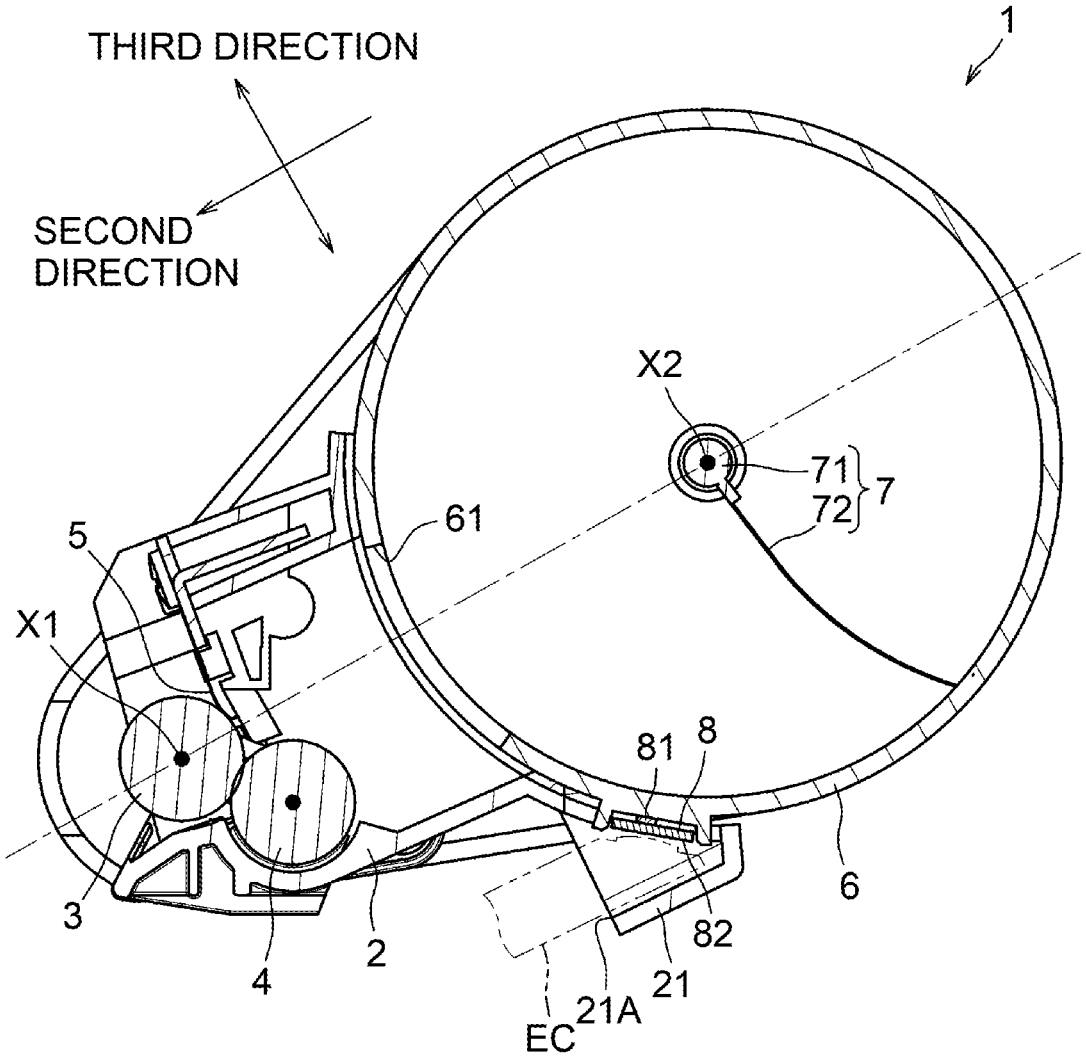
FIG. 1 is a sectional view of a developer cartridge according to an illustrative embodiment of the disclosure.

An illustrative embodiment of the disclosure will now be described with reference to the drawings. A developer cartridge 1 is used in an image forming device, e.g., a printer. As shown in FIG. 1, the developer cartridge 1 includes a frame 2, a developing roller 3, a supply roller 4, a blade 5, a housing 6, an agitator 7, a memory 8, and a cover 21.

The frame 2 supports the developing roller 3, the supply roller 4, and the blade 5. The frame 2 is made of resin.

The developing roller 3 is rotatable about a first axis X1 extending in a first direction. In this illustrative embodiment, the first direction corresponds to an extending direction of the first axis X1 which is a rotation axis of the developing roller 3. The developing roller 3 is configured to contact a photosensitive drum (not shown) of an image forging device or the like. The developing roller 3 is configured to supply toner to the photosensitive drum when the developer cartridge 1 is mounted to the image forming device.

The supply roller 4 is positioned between the developing roller 3 and the cover 21. A surface of the supply roller 4 is in contact with a surface of the developing roller 3. The supply roller 4 supplies toner to the developing roller 3.

The blade 5 is positioned to contact the developing roller 3. Specifically, a distal end of the blade 5 is in contact with a surface of the developing roller 3. The blade 5 regulates the thickness of toner on the developing roller 3.

The housing 6 is positioned in contact with the frame 2. The housing 6 is cylindrical and configured to store toner therein. The housing 6 has one end portion 6A and the other end portion 6B in the first direction (refer to FIG. 2). The housing 6 has a supply port 61 and a refill port 65 (refer to FIG. 4). Toner is supplied via the supply port 61 to a developing chamber inside the frame 2. As shown in FIG. 3, the supply port 61 is rectangular and extends in the first direction. The housing 6 is refiled with toner via the refill port 65. The housing 6 is made of resin. The housing 6 may be molded into a single part without joints. For example, the housing 6 may be made by blow molding.

Bearings 62 and 63, which are provided at opposite ends in the first direction of the housing 6, support the agitator 7. A cap 64 fastens the bearing 63 at the other end portion 6B in the first direction of the housing 6, and is fitted into the refill port 65 to seal the toner in the housing 6.

As shown in FIG. 1, the agitator 7 is rotatable about a second axis X2 extending in the first direction. The agitator 7 is positioned spaced apart from the developing roller 3. The agitator 7 includes a shaft 71 extending in the first direction, and an agitator paddle 72.

The agitator paddle 72 is attached to the shaft 71. Thus, the agitator paddle 72 is rotatable with the shaft 11 to agitate the toner in the housing 6. The agitator paddle 72 is configured to slidably contact an inner circumferential surface of the housing 6. The agitator paddle 72 is made of a flexible sheet, e.g., a polyethylene terephthalate (PET) film.

Figure 5:
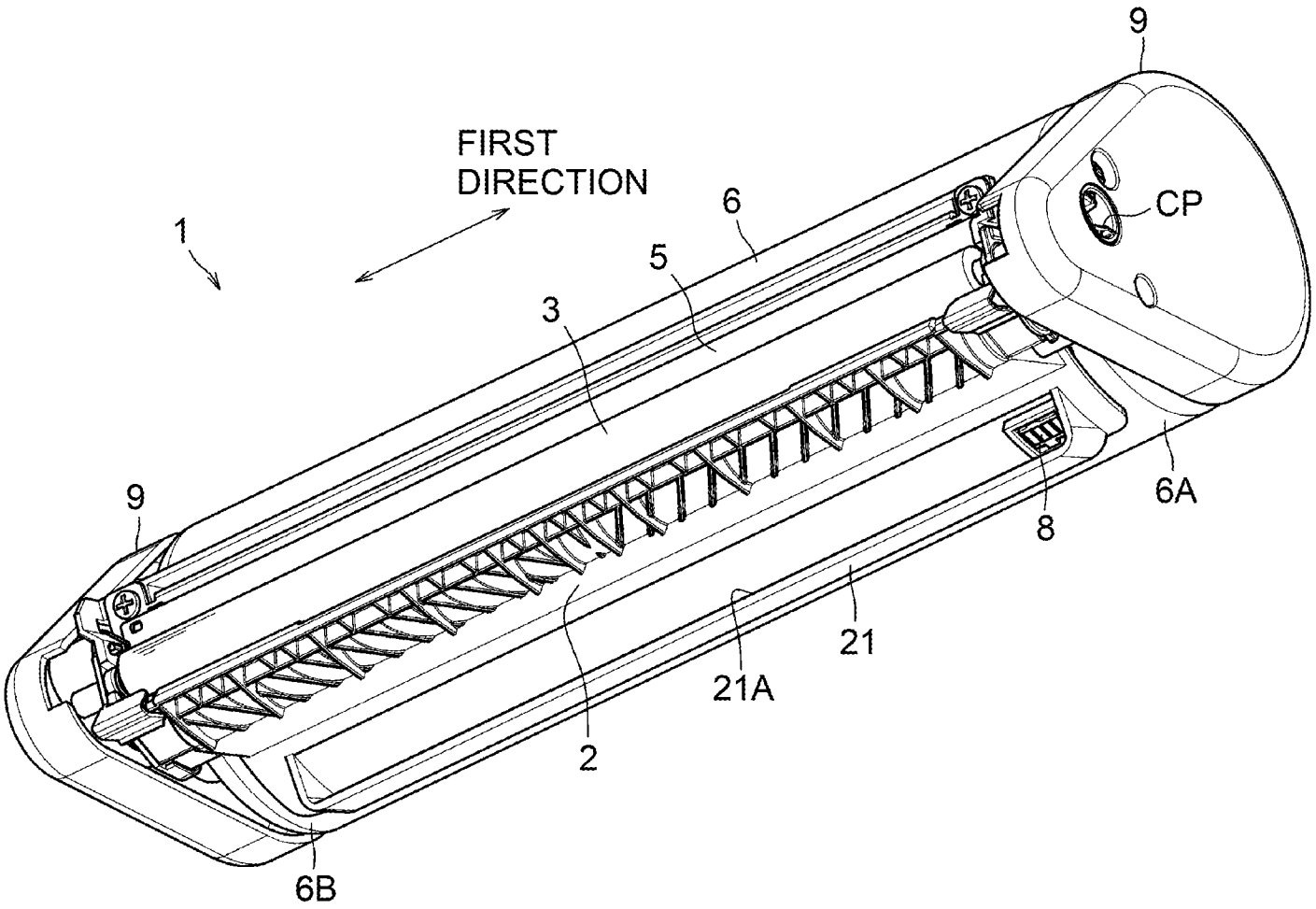
FIG. 5 is a perspective view of the developer cartridge as viewed from a different direction from in FIG. 2.
Figure 6:
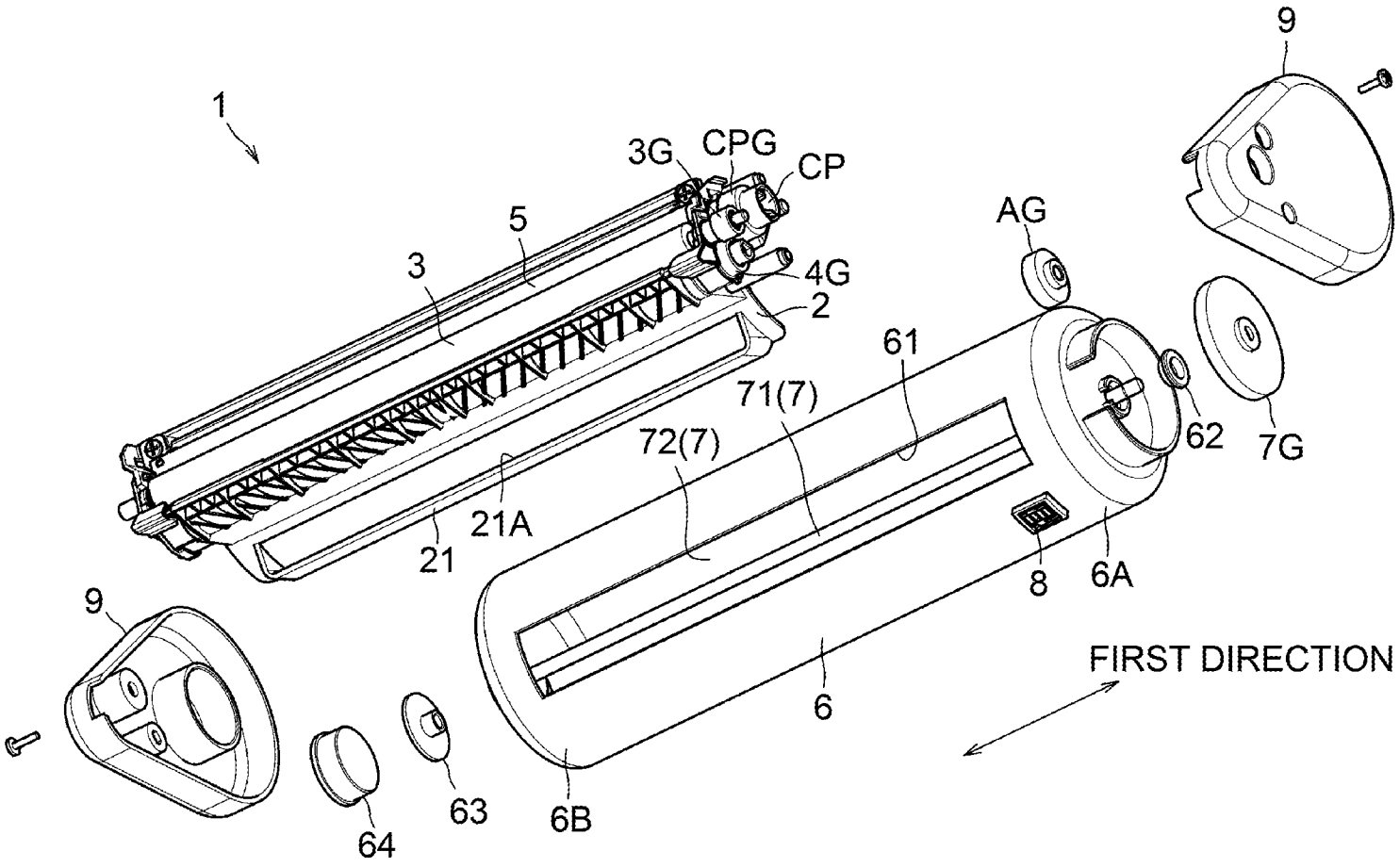
FIG. 6 is an exploded perspective view of the developer cartridge of FIG. 5.

The memory 8 is positioned at an outer surface of the housing 6. Specifically, the memory 8 is positioned at an outer circumferential surface of the housing 6. The memory 8 is positioned between the developing roller 3 and the agitator 7 in a second direction from the first axis X1 toward the second axis X2 (hereinafter simply referred to as a "second direction"). The memory 8 is positioned between the first axis X1 and the second axis X2 in the second direction. In this illustrative embodiment, the memory 8 is positioned closer to the second axis X2 than to the first axis X1 in the second direction. The memory 8 is positioned at the one end portion 6A of the housing 6 in the first direction (refer to FIG. 5). The memory 8 includes a memory element 81 and an electrical contact surface 82.

The memory 8 may be an integrated circuit (IC) chip or other storage media for storing information. The memory element 81 stores product information on the developer cartridge 1. The product information may include at least one of the cumulative number of rotations of the developing roller 3, the used dot count, the amount of remaining toner. The memory element 81 may be positioned away from the electrical contact surface 82. In this case, the memory element 81 and the electrical contact surface 82 are electrically connected with a harness.

The electrical contact surface 82 is positioned at an outer surface of the housing 6. Specifically, the electrical contact surface 82 is positioned at an outer circumferential surface of the housing 6. The electrical contact surface 82 is positioned at the one end portion 6A of the housing 6 in the first direction (refer to FIG. 5). The electrical contact surface 82 is positioned between the developing roller 3 and the agitator 7 in the second direction. The electrical contact surface 82 is positioned between the first axis X1 and the second axis X2 in the second direction. In this illustrative embodiment, the electrical contact surface 82 is positioned closer to the second axis X2 than to the first axis X1 in the second direction.

The cover 21 has an opening 21A. The cover 21 covers the electrical contact surface 82. Specifically, the cover 21 covers the electrical contact surface 82 in a third direction which is orthogonal to the first direction and the second direction. The cover 21 is a portion of the frame 2. In other words, the cover 21 is integral with the frame 2. The cover 21 extends in the first direction (refer to FIG. 5).

The opening 21 is open in the second direction. The opening 21A is rectangular and extends in the first direction (refer to FIG. 5). The opening 21 allows an electrical connector EC (shown by a two-dot chain line in FIG. 1) to be inserted therein and to contact the electrical contact surface 82.

Figure 7:
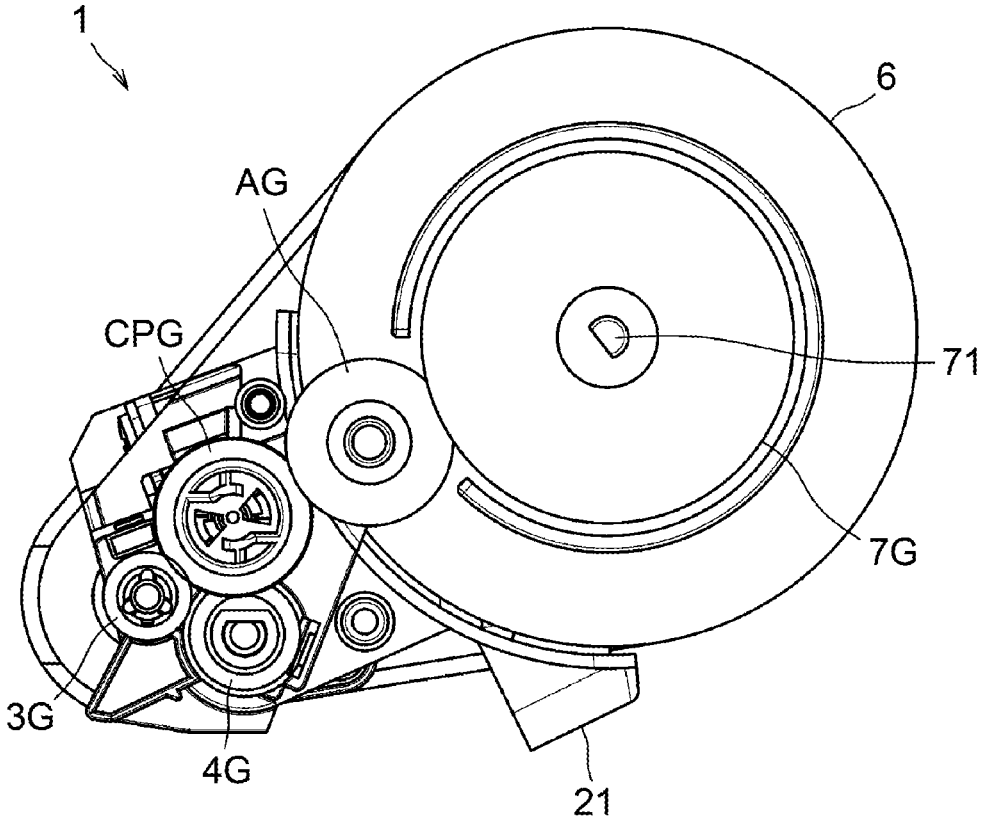
FIG. 7 is a view showing the relation of gears.

As shown in FIG. 3, a coupling CP is positioned, at an end portion of developer cartridge 1 in the first direction, to receive drive. The coupling CP includes a coupling gear CPG. The developing roller 3 includes a developing roller gear 3G for transmitting drive to the developing roller 3. The supply roller 4 includes a supply roller gear 4G for transmitting drive to the supply roller 4. The agitator 7 includes an agitator gear 7G for transmitting drive to the agitator 7. An idle gear AG is disposed between the coupling gear CPG and the agitator gear 7G. As shown in FIG. 7, the coupling gear CPG receives a drive force and transmits the drive force to the developing roller gear 3G and the supply roller gear 4G. The coupling gear CPG also transmits the received drive force to the agitator gear 7G via the idle gear AG. Gear teeth of the gears are omitted from the drawings.

Figure 2:
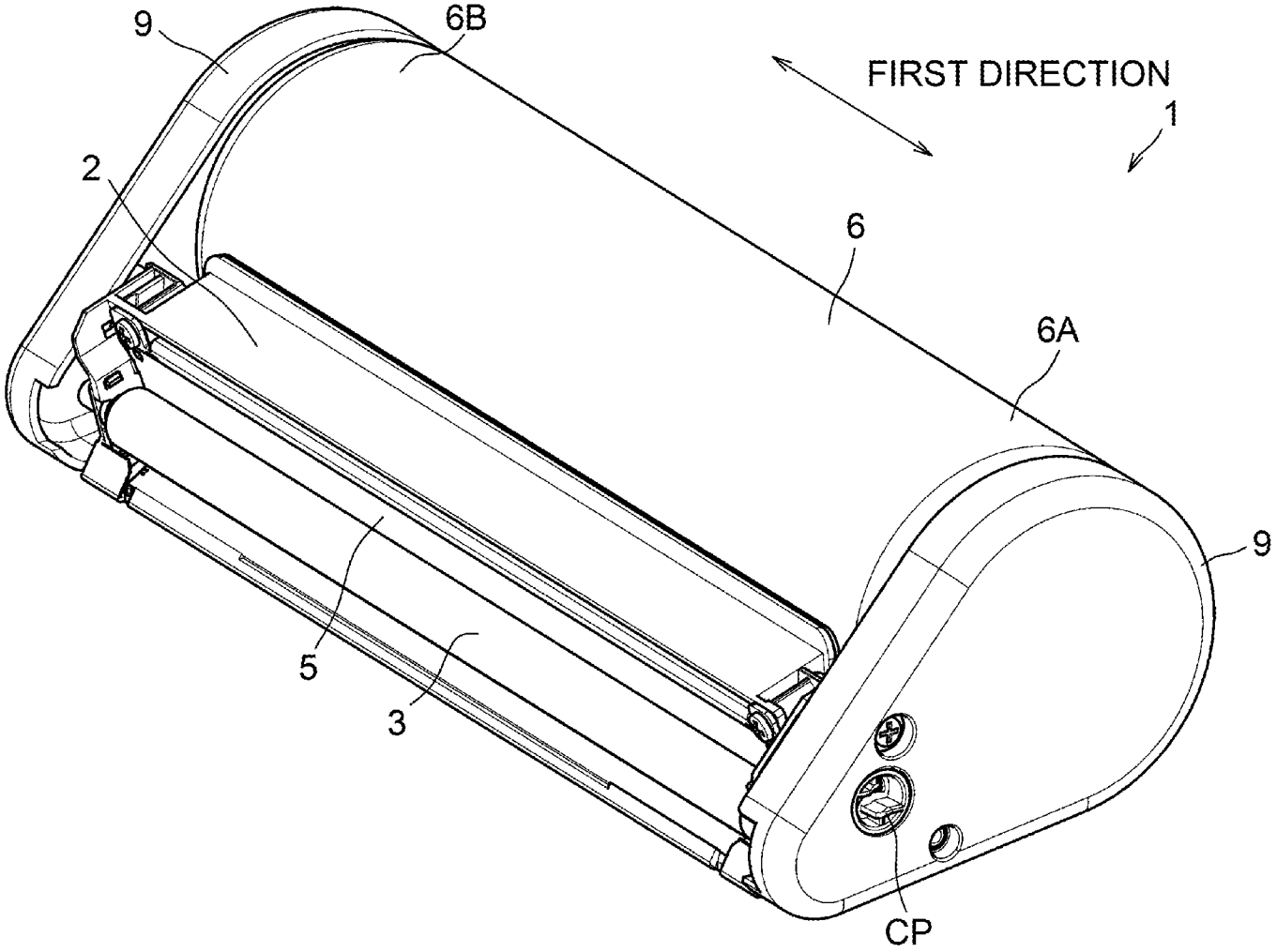
FIG. 2 is a perspective view of the developer cartridge.
Figure 3:
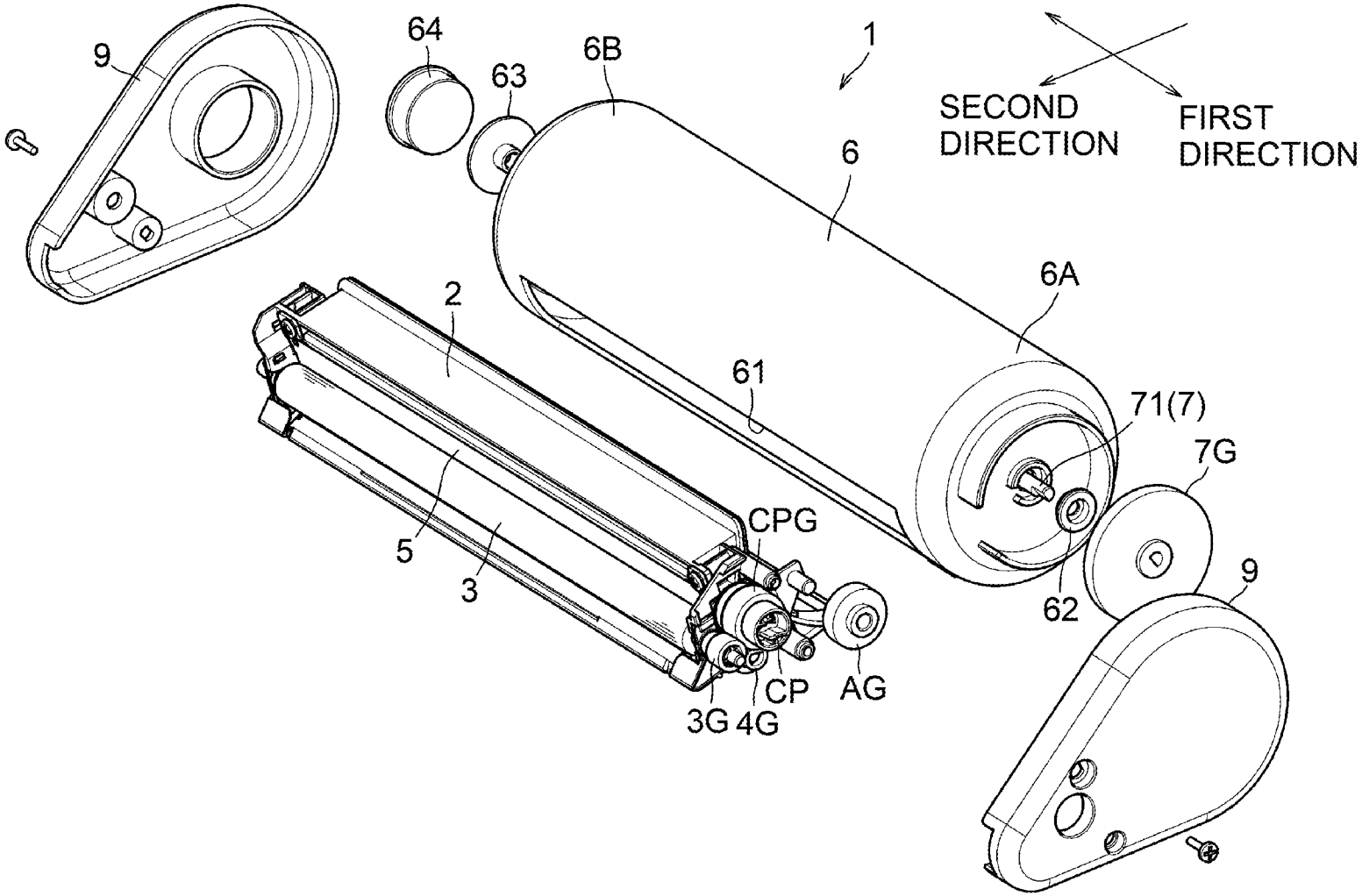
FIG. 3 is an exploded perspective view of the developer cartridge of FIG. 2.
Figure 4:
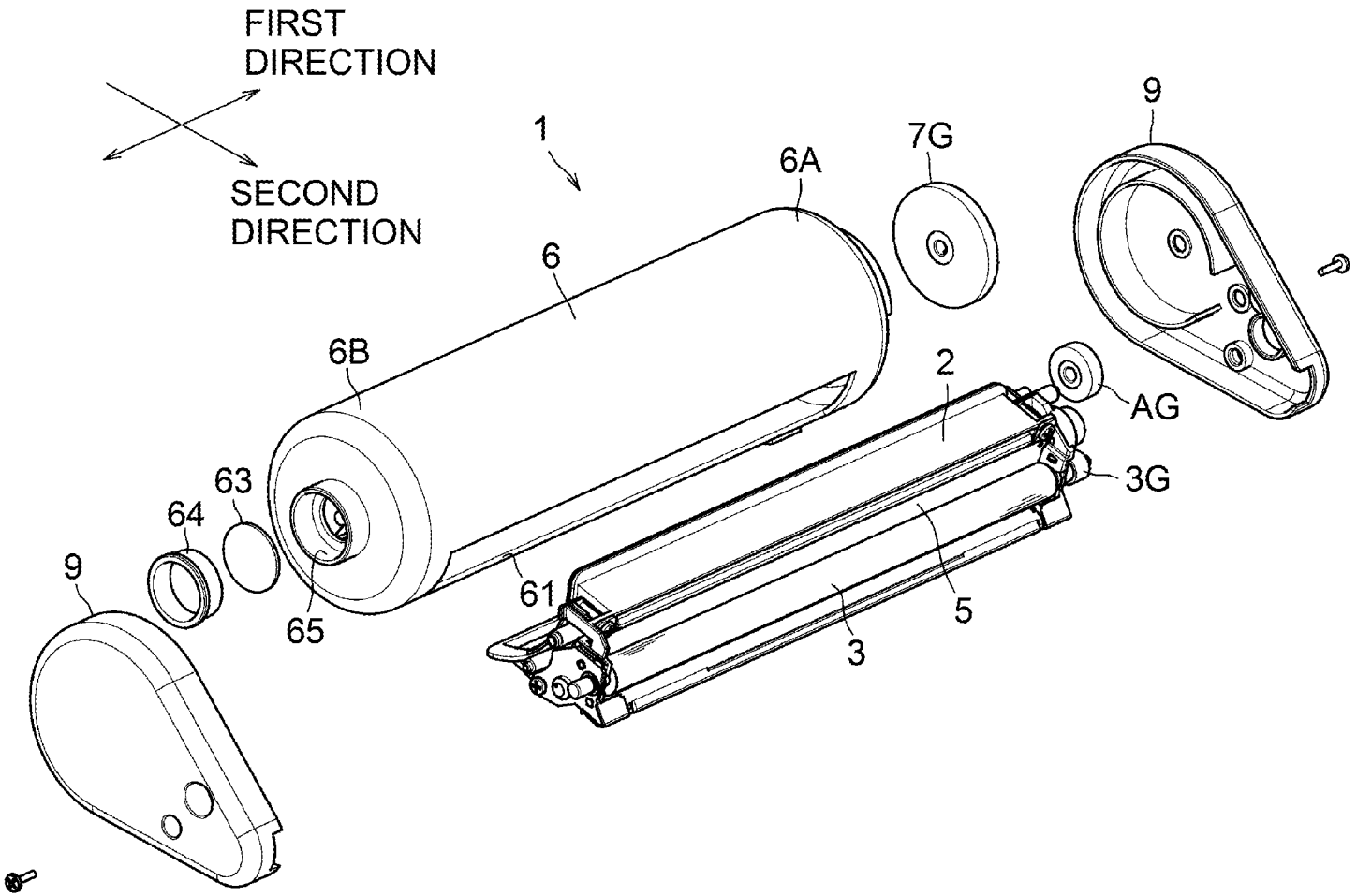
FIG. 4 is an exploded perspective view of the developer cartridge as viewed from a different direction from in FIG. 3.

As shown in FIGS. 2 and 3, the developer cartridge 1 further includes a pair of holders 9. The holders 9 hold and couple the frame 2 and the housing 6. One of the holders 9 covers the gear train so as not to be exposed to an exterior of the developer cartridge 1.

The developer cartridge 1 according to the above-described embodiment provides advantageous effects, as below.

The developer cartridge 1 includes the cover 21 which covers the electrical contact surface 82. The cover 21 may prevent or reduce unnecessary rubbing against the electrical contact surface 82. The cover 21 may prevent or reduce unnecessarily touching of the electrical contact surface 82 by a user.

The cover 21 is a portion of the frame 2. This may suppress increase in the number of components.

The cover 21 and the opening extend in the first direction. This allows a component other than the electrical contact surface 82 to be disposed in the cover 21.

The opening 21 allows the electrical connector EC to be inserted therein and to contact the electrical contact surface 82. This facilitates insertion of the electrical connector EC into the opening 21A and contact of the electrical connector EC with the electrical contact surface 82.

While the disclosure has be described in detail with reference to the specific embodiment thereof, various changes, arrangements, and modifications may be applied, as below.

Although, in the above-described embodiment, the agitator paddle 72 is made of a PET film, the agitator paddle 72 may be made of a different resin film or other materials such as a metal plate.

Although, in the above-described embodiment, the frame 2 is made of resin, the frame 2 may be made of other materials such as metal.

Although, in the above-described embodiment, the housing 6 is made of resin, the housing 6 may be made of other materials such as metal. The housing 6 may be made other than by blow molding.

Although, in the above-described embodiment, the electrical contact surface 82 is positioned at the one end portion 6A of the developer cartridge 1 in the first direction, the electrical contact surface 82 may be positioned at the other end portion 6B or at a central portion in the first direction.

A developer cartridge may be configured by combining one or more elements described in the illustrative embodiment with one or more elements described in the modifications.

What is claimed is:

1. A developer cartridge comprising:

a housing configured to store toner therein and having one end portion and another end portion in a first direction;

a developing roller rotatable about a first axis extending in the first direction;

an agitator rotatable about a second axis extending in the first direction, the agitator being positioned spaced apart from the developing roller;

a memory including an electrical contact surface which is positioned at an outer surface of the housing and at the one end portion of the housing in the first direction, and is positioned between the developing roller and the agitator in a second direction from the first axis toward the second axis; and a cover having an opening open in the second direction, the cover at least partially covering the electrical contact surface in a third direction that is orthogonal to the first and second directions.

2. The developer cartridge according to claim 1, wherein the housing is cylindrical, and the electrical contact surface is positioned at an outer circumferential surface of the housing.

3. The developer cartridge according to claim 1, further comprising a frame supporting the developing roller, wherein the cover is a portion of the frame.

4. The developer cartridge according to claim 1, wherein the cover and the opening extend in the first direction.

5. The developer cartridge according to claim 1, further comprising a supply roller configured to supply the toner to the developing roller, the supply roller being positioned between the developing roller and the cover.

6. The developer cartridge according to claim 1, wherein the opening allows an electrical connector of an image forming device to be inserted therein and to contact the electrical contact surface.

7. The developer cartridge according to claim 1, wherein the memory includes a memory element that is positioned at the outer surface of the housing and at the one end portion of the housing in the first direction, and is positioned between the developing roller and the agitator in the second direction.

8. The developer cartridge according to claim 1, wherein the housing has a first end at the one end portion and a second end at the another end portion, wherein the housing is configured to store the toner between the first and second ends, and wherein the electrical contact surface is positioned between the first and second ends in the first direction.

9. A developer cartridge comprising:

a housing configured to store toner therein and having one end portion and another end portion in a first direction, the housing having a first end at the one end portion and a second end at the another end portion, wherein the housing is configured to store the toner between the first and second ends;

a developing roller rotatable about a first axis extending in the first direction;

an agitator rotatable about a second axis extending in the first direction, the agitator being positioned spaced apart from the developing roller;

a memory including an electrical contact surface which is positioned at an outer surface of the housing and at the one end portion of the housing in the first direction, and is positioned between the developing roller and the agitator in a second direction from the first axis toward the second axis; and a cover having an opening open in the second direction, the cover covering the electrical contact surface, wherein the electrical contact surface is positioned between the first and second ends of the housing in the first direction.

* * * * *